US007553188B2

(12) United States Patent
Whiteman, Jr. et al.

(10) Patent No.: US 7,553,188 B2
(45) Date of Patent: Jun. 30, 2009

(54) SLIDE LOCK PANEL-MOUNT CONNECTOR

(75) Inventors: Robert Neil Whiteman, Jr., Middletown, PA (US); Christopher David Ritter, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 4 days.

(21) Appl. No.: 11/732,913

(22) Filed: Apr. 5, 2007

(65) Prior Publication Data

US 2008/0248697 A1 Oct. 9, 2008

(51) Int. Cl.
*H01R 13/648* (2006.01)

(52) U.S. Cl. ..... 439/607; 439/560; 439/552; 439/565

(58) Field of Classification Search ..... 439/557, 439/552, 555, 560, 562, 565, 607
See application file for complete search history.

(56) References Cited

U.S. PATENT DOCUMENTS 3,753,212 A * 8/1973 Yamada et al. ..... 439/358
5,586,915 A 12/1996 Baker et al.
5,591,035 A 1/1997 Burkholder et al.
5,595,509 A 1/1997 Fry et al.
6,095,854 A 8/2000 Sommer et al.
6,176,738 B1 1/2001 Consoli et al.
6,217,364 B1 4/2001 Miskin et al.
6,312,285 B1 11/2001 Berg et al.
7,137,847 B2 * 11/2006 Trout et al. ..... 439/465
7,168,978 B1 * 1/2007 Trout et al. ..... 439/545
7,371,110 B2 * 5/2008 Murakami et al. ..... 439/557
2006/0194473 A1 * 8/2006 Lange ..... 439/557

* cited by examiner

*Primary Examiner*—Tho D Ta
*Assistant Examiner*—Travis Chambers

(57) ABSTRACT

An electrical connector for mounting to a panel includes a housing configured to be mounted to the panel, and a deflectable latch including a latch arm having a length extending in a longitudinal direction between a fixed end secured to the housing and a free end movable with respect to the housing. The free end has a locking finger extending therefrom. The latch arm is deflected laterally with respect to the length thereof to align the locking finger with an opening through the panel. The deflectable latch returns to a resting position once the housing is mounted to the panel, and the locking finger engages the panel when in the resting position.

19 Claims, 6 Drawing Sheets

SLIDE LOCK PANEL-MOUNT CONNECTOR

BACKGROUND OF THE INVENTION

This invention relates generally to electrical connectors, and more specifically, to slide lock panel-mount connectors.

Conventional cable-to-cable or cable-to-board connectors typically include a receptacle connector and a plug connector. Contacts of the connectors are interconnected to one another during mating of the connectors. At least some known connectors provide thumb screws on the receptacle connector that may be secured to the plug connector or chassis surrounding the plug connector. By tightening the thumb screws, the connectors become fully mated, and removal of the receptacle connector from the plug connector is restricted. However, other problems are associated with the use of such known thumb screws. Particularly, tightening and un-tightening the thumb screws is difficult and sometimes uncomfortable for the user. Additionally, tightening and un-tightening the thumb screws is time consuming.

Some known connectors suffer from problems associated with the mating of the connectors. For example, the connectors typically require alignment and proper orientation of the receptacle connector and the plug connector for mating. Sometimes visibility or accessibility are limited, which makes it difficult for a user to align and orient the connectors. Furthermore, more and more contacts are being housed in each connector to accommodate higher power demands through the connectors. As a result, the connectors are more difficult to mate with one another because the mating force required to fully mate the connectors is increased. Improper mating of the connectors may lead to a partial or complete failure of the system operated by the connectors.

Moreover, the plug connectors are typically mounted to a panel or chassis, and the accessibility of the panel may be limited. As such, it may be difficult to properly mount the plug connector during assembly. The plug connectors are typically secured to the panel using screws. However, multiple components and/or other plug connectors may be attached to the panel or may be positioned in the vicinity of the panel, making it difficult to access the panel to tighten the screws to attach the plug connector to the panel. As such, the assembly of the plug connector with the panel may be difficult and time consuming.

A need exists for connectors that may be mated in a convenient and efficient manner, and with less mating force and less stress on the contacts. Additionally, a need exists for connectors that may be mounted to the panel or chassis in a convenient and efficient manner.

BRIEF DESCRIPTION OF THE INVENTION

In one embodiment, an electrical connector is provided for mounting to a panel, wherein the connector includes a housing configured to be mounted to the panel, and a deflectable latch including a latch arm having a length extending in a longitudinal direction between a fixed end secured to the housing and a free end movable with respect to the housing. The free end has a locking finger extending therefrom. The latch arm is deflected laterally with respect to the length thereof to align the locking finger with an opening through the panel. The deflectable latch returns to a resting position once the housing is mounted to the panel, and the locking finger engages the panel when in the resting position.

Optionally, the deflectable latch may be deflectable in a deflecting direction generally toward the housing and a locking direction generally away from the housing. The housing may include side walls extending between a front and a rear of the housing, wherein the latch arm is secured to the housing and extends parallel to one of the side walls. The latch arm may be deflectable in a first deflecting direction transverse to the longitudinal direction and perpendicular to the side wall, and a second deflecting direction transverse to the longitudinal direction and parallel to the side wall. Optionally, the panel may include a single opening, wherein the housing and the locking finger both extend through the single opening. The housing may include mounting tabs that are configured to engage the panel, wherein at least one of the mounting tabs is positioned to engage a surface of the latch to inhibit removal of the housing from the panel opening when the latch is in the resting position. Optionally, the deflectable latch may include a C-shaped body extending between the fixed end and the free end.

In another embodiment, an electrical connector for mounting to a panel is provided that includes a housing having a front, a rear and side walls extending between the front and the rear. The housing is configured to be loaded through an opening in the panel to a loaded position, and the housing is configured to be slid in a mounting direction to a mounted position. Mounting tabs extend from the housing, and are configured to be loaded through the opening with the housing. Each mounting tab has a rear surface opposite the mating side of the housing configured to engage the panel when the housing is slid in the mounting direction to the mounted position. A latch is secured to the housing, and the latch has a locking finger. The latch is deflectable to permit the locking finger to move through the opening when the housing is in the mounted position, and the locking finger engages the panel when the housing is in the mounted position.

In a further embodiment, an electrical connector for mounting to a panel is provided that includes a housing having a front, a rear and side walls extending between the front and the rear, and being configured to be loaded through an opening in the panel to a loaded position. The housing is also configured to be slid in a mounting direction to a mounted position. A deflectable latch is secured to the housing and includes a latch arm and a locking finger at a distal end of the latch arm. The locking finger is positioned to engage the panel when the latch arm is in a resting position to lock the housing in positioned with respect to the panel. The latch arm is deflected in a deflecting direction toward an adjacent one of the side walls to align the locking finger with the opening, and the latch arm is retracted in a retracting direction parallel to the adjacent one of the side walls to retract the locking finger from the opening. The housing is configured to be moved between the mounted position and the loaded position when the latch arm is in the retracted position.

DETAILED DESCRIPTION OF THE INVENTION

Figure 1:
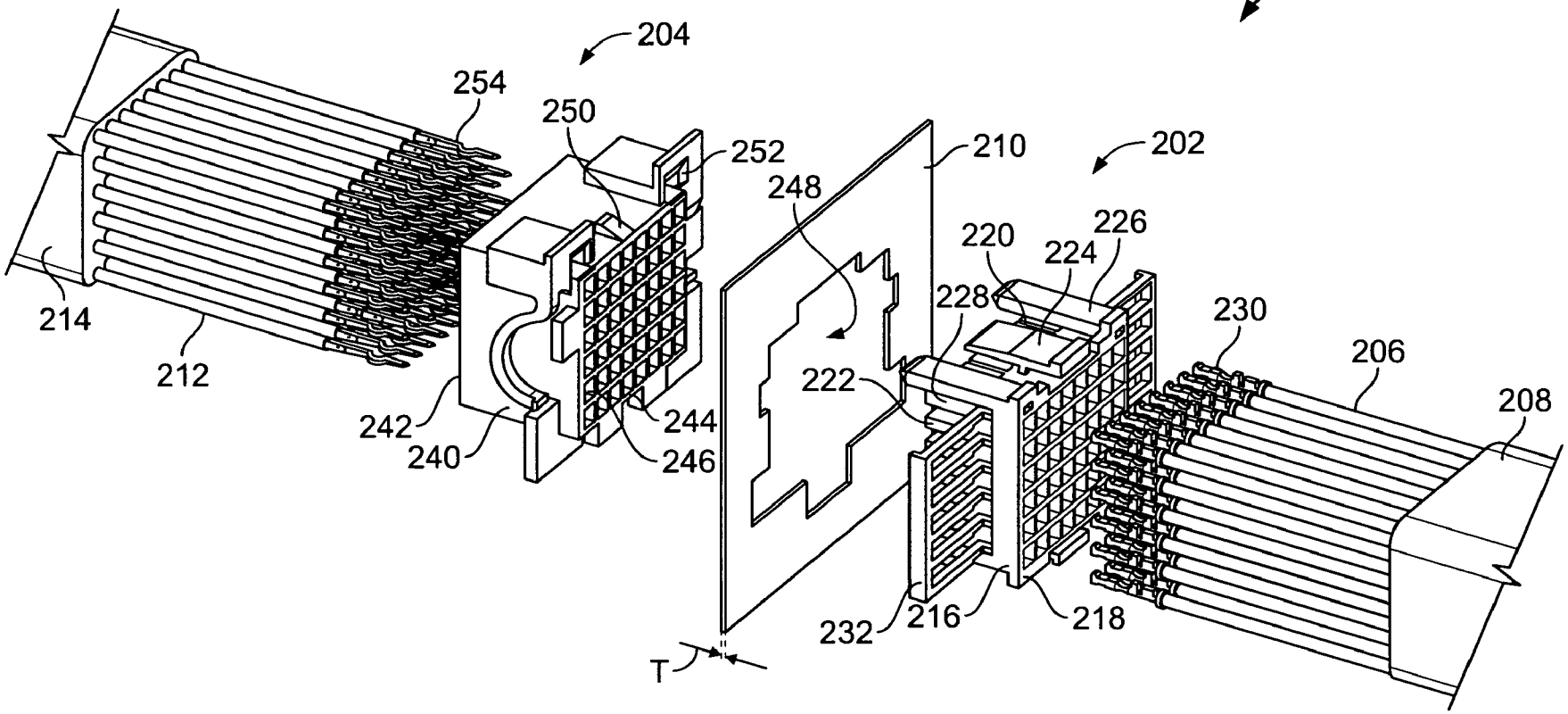
FIG. 1 illustrates an exploded perspective view of a connector assembly formed in accordance with an exemplary embodiment.

FIG. 1 is an exploded perspective view of a connector assembly 200 having a receptacle connector 202 and a plug connector 204. In the illustrated embodiment, the receptacle connector 202 is a cable connector for terminating a plurality of wires 206 of a cable 208. The cable 208 may be transmitting power, data, or both. In the illustrated embodiment, the plug connector 204 is a panel connector that may be mounted to a panel, a backplane, a chassis or the like, generally identified 210. The panel 210 generally has opposed planar surfaces separated by a thickness T. Optionally, the plug connector 204 may be terminated to wires 212 of another cable 214. As such, the connector assembly 200 generally defines a cable-to-cable connector assembly. Alternatively, the plug connector 204 may be terminated to an integrated circuit or circuit board (not shown).

The receptacle connector 202 may be similar to the receptacle connector as described in commonly owned U.S. application Ser. No. 11/445,524, filed Jun. 2, 2006 and entitled "ELECTRICAL CONNECTOR HAVING STAGGERED CONTACTS", the complete subject matter of which is expressly incorporated by reference herein in its entirety. The receptacle connector 202 includes an insulative housing 216 that is generally box shaped. A rear 218 of the housing 216 defines a contact loading end, and a front 220 defines a mating end. The housing 216 includes a plurality of receptacle contact cavities 222 arranged in a matrix having M columns of contact cavities 222 and N rows of contact cavities 222. Optionally, at least some of the contact cavities 222 may include chamfered surfaces at the mating end or front 220 of the housing 216.

The receptacle connector 202 includes locking members 224 that lockably engage the plug connector 204 when the receptacle connector 202 is mated to the plug connector 204. In the exemplary embodiment, the locking members 224 represent latches that may be pivoted to release the locking members 224 from the plug connector 204. The receptacle connector 202 includes blind mating members 226 that may be used as keying features during mating of the receptacle connector 202 with the plug connector 204. The blind mating members 226 also orient and align contact silos 228 that surround the contact cavities 222 with respect to the plug connector 204 prior to mating. In the exemplary embodiment, the blind mating members 226 represent beams having a generally rectangular shape that engage the plug connector 204 prior to the contact silos 228 engaging the plug connector 204.

As described above, the cable 208 and the plurality of wires 206 are terminated to the receptacle connector 202. In the exemplary embodiment, the receptacle connector 202 includes a plurality of receptacle contacts 230 that are received within the contact cavities 222 during assembly of the receptacle connector 202. Each contact 230 includes a mating end and a wire terminating end. An exposed portion of one of the wires 206 is terminated to the wire terminating end by a crimping process. Alternatively, another terminating process, such as a soldering process or an insulation displacement process may be used. In an exemplary embodiment, the contact 230 represents a crimp-snap style contact that is attached to a wire via a crimping process and snappably retained within the contact cavities 222. Once terminated, the contact 230 is loaded into the contact loading end or rear 218 of the housing 216 into a corresponding contact cavity 222. Alternatively, the wire 206 may be terminated to the contact 230 after the contact 230 is loaded into the contact cavity 222. Optionally, a portion of the contact 230 may be configured to engage a positive locking member 232 to resist removal from the contact cavity 222. In an exemplary embodiment, the contacts 230 are substantially aligned within the contact cavities 222 such that the mating ends of the contacts 230 are arranged along a common plane. Alternatively, the contacts 230 may be staggered within the contact cavities 222 such that the mating ends of the contacts 230 are arranged in more than one plane.

As illustrated in FIG. 1, the plug connector 204 includes an insulative housing 240 that is generally box shaped. A rear 242 of the housing 240 defines a contact loading end, and a front 244 defines a mating end. The housing 240 includes a plurality of receptacle contact cavities 246 arranged in a matrix having M columns of contact cavities 246 and N rows of contact cavities 246 corresponding to the contact cavities 222 of the receptacle connector 202. Optionally, at least some of the contact cavities 246 may include chamfered surfaces.

The plug connector 204 is mountable to the panel 210 without the use of any fasteners or special tools. Optionally, the plug connector 204 may be attached to the panel 210 by a hand of a users for convenience and ease of assembly. In an exemplary embodiment, the front 244 of the housing 240 extends through an opening 248 in the panel 210 and is oriented for mating with the receptacle connector 202. The opening 248 is shaped to accommodate the housing 240, and includes notch-outs for the various features of the housing 240, which will be explained in more detail below. The plug connector 204 includes features that securely mount the plug connector 204 to the panel 210. Optionally, the panel 210 may be sized and/or shaped differently than in the illustrated embodiment, and the panel 210 may include multiple openings 248 for receiving more than one plug connector 204.

The plug connector 204 includes locking members 250 that cooperate with the locking members 224 of the receptacle connector 202 to secure the receptacle connector 202 to the plug connector 204. In the exemplary embodiment, the locking members 250 represent catches extending outwardly from the housing 240. The plug connector 204 includes blind mating members 252 that may be used as keying features during mating of the receptacle connector 202 with the plug connector 204. In the exemplary embodiment, the blind mating members 252 represent openings having a generally rectangular shape that receive the blind mating members 226 of the receptacle connector 202.

As described above, the cable 214 and the plurality of wires 212 are terminated to the plug connector 204. In the exemplary embodiment, the plug connector 204 includes a plurality of plug contacts 254 that are received within the contact cavities 246 during assembly of the plug connector 204. Each contact 254 includes a mating end and a wire terminating end. An exposed portion of one of the wires 212 is terminated to the wire terminating end by a crimping process. Alternatively, another terminating process, such as a soldering process or an insulation displacement process may be used. In an exemplary embodiment, the contact 254 represents a crimp-snap style contact that is attached to a wire via a crimping process and snappably retained within the contact cavities 246. Once terminated, the contact 254 is loaded into the contact loading end or rear 242 of the housing 240 into a corresponding contact cavity 246. Alternatively, the wire 212 may be terminated to the contact 254 after the contact 254 is loaded into the contact cavity 246.

Optionally, the depth of placement of each contact 254 within the contact cavities 246 may be controlled such that the mating ends of a first set of contacts 254 may be placed at a first depth with respect to the mating end or front 244 of the housing 240, and the mating ends of a second set of contacts 254 may be placed at a second depth with respect to the mating end or front 244 of the housing 240. As such, the mating ends of the first set of contacts 254 may all be aligned along a first plane that is parallel to the front 244 and the mating ends of the second set of contacts 254 may all be aligned along a second plane that is also parallel to the front 244 but spaced apart from the first plane. The first plane may be off-set toward, or positioned relatively closer to, the front 244 with respect to the second plane. As a result, during mating of the receptacle connector 202 and the plug connector 204, the contacts 230 of the receptacle connector 202 interface with the first set of contacts 254 prior to interfacing with the second set of contacts 254. The mating forces are thus reduced. Optionally, the contacts 254 in the odd numbered columns are received within the contact cavities 246 to the first depth and the contacts 254 in the even numbered columns are received within the contact cavities 246 to the second depth. Alternatively, the contacts 254 in the odd numbered rows are received within the contact cavities 246 to the first depth and the contacts 254 in the even numbered rows are received within the contact cavities 246 to the second depth. In other alternative embodiments, each adjacent contact 254 may be in at a different depth, such that the contacts 254 are staggered by both row and column, or the pattern of contacts 254 placed at the first depth may be randomized or clustered, and may not be defined by column or row.

Figure 2:
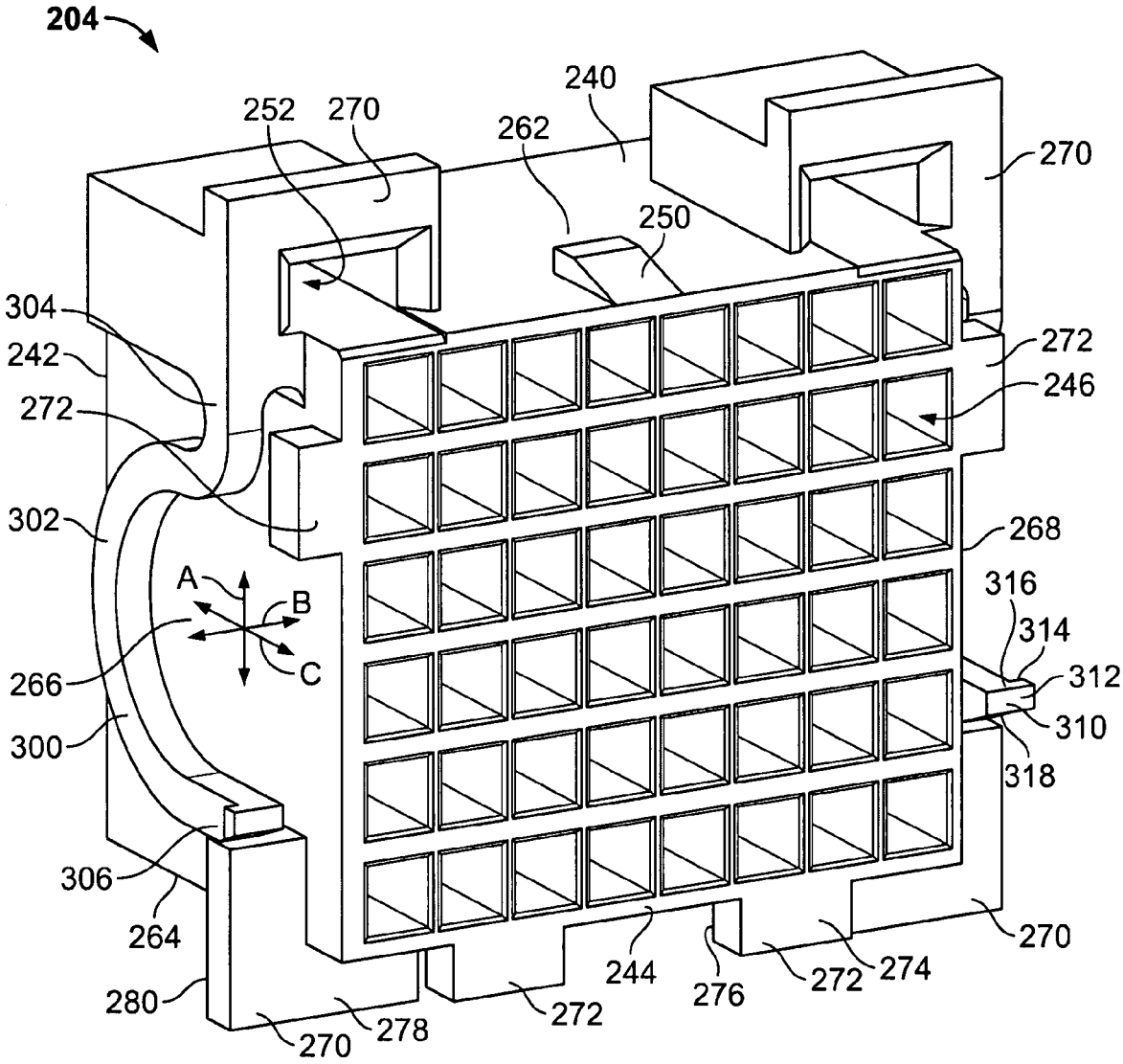
FIG. 2 is a front perspective view of a plug connector of the connector assembly shown in FIG. 1.

FIG. 2 is a front perspective view of the plug connector 204. The plug connector 204 includes a top 262, a bottom 264, a first side 266 and a second side 268 each extending between the front 244 and rear 242. The plug contact cavities 246 extend from the front 244 to the rear 242. The contact cavities 246 are generally hollow rectangular openings. Optionally, at least some of the contact cavities 246 may include chamfered surfaces at the mating end or front 244 of the housing 240. The positioning of the contact cavities 246 having chamfered surfaces may be used for polarizing or keying the mating of the plug connector 204 and the receptacle connector 202 (shown in FIG. 1). The contact cavities 246 may be tapered from front 244 to rear 242 or from rear 242 to front 244.

The plug connector 204 includes inner mounting tabs 270 and outer mounting tabs 272 extending from the housing 240 for mounting the housing 240 to the panel 210 (shown in FIG. 1). The outer mounting tabs 272 extend outward from the housing 240 proximate to the front 244. In an exemplary embodiment, the outer mounting tabs 272 are flush with the front 244, however the tabs 272 may be recessed from the front 244. The outer mounting tabs 272 include a forward facing surface 274 and a rearward facing surface 276. The forward facing surface 274 is parallel to, and faces, the front 244. The rearward facing surface 276 is parallel to the forward facing surface 274 and faces the rear 242 of the housing 240. In the illustrated embodiment, the housing 240 includes two outer mounting tabs 272 extending from the bottom 264 of the housing 240, and the tabs 272 are spaced apart from one another. The locking member 250 is positioned between the two tabs 272 on the bottom 264. In the illustrated embodiment, the housing 240 also includes two outer mounting tabs 272 on either side 266, 268 of the housing 240. These two tabs 272 are positioned proximate the top 262. While four outer mounting tabs 272 are illustrated, it is realized that more or less mounting tabs 272 may be provided in alternative embodiments, and the location of the mounting tabs 272 may be different in other embodiments.

The inner mounting tabs 270 extend outward from the housing 240 proximate to the front 244. In an exemplary embodiment, the inner mounting tabs 270 are recessed from the front 244 and from the outer mounting tabs 272 by a distance. The inner mounting tabs 270 include a forward facing surface 278 and a rearward facing surface 280. The forward facing surface 278 is parallel to, and faces, the rearward facing surface 276 of the outer mounting tabs 272. The forward facing surface 278 is spaced apart from the rearward facing surface 276 by a distance that is substantially equal to the thickness T of the panel 210 (shown in FIG. 1). Once assembled, as explained in further detail below, the inner and outer tabs 270, 272 cooperate to hold the panel 210 between the forward facing surface 278 and the rearward facing surface 276, such as by a friction fit. The rearward facing surface 280 of the inner mounting tab 270 is parallel to the forward facing surface 278 and faces the rear 242 of the housing 240. In the illustrated embodiment, the housing 240 includes two inner mounting tabs 270 extending from the bottom corners of the housing 240 and two inner mounting tabs 270 extending from the top corners of the housing 240. The inner mounting tabs 270 at the bottom corners extend from both the bottom 264 and the respective side 266 or 268. The inner mounting tabs 270 at the top corners surround the blind mating members 252. While four inner mounting tabs 270 are illustrated, it is realized that more or less mounting tabs 270 may be provided in alternative embodiments, and the location of the mounting tabs 270 may be different in other embodiments.

The plug connector 204 includes deflectable latches 300 on either side 266, 268 of the housing 240. The latches 300 are used to lock the housing 240 within the opening 248 of the panel 210. Each latch 300 includes a latch arm 302 extending in a longitudinal direction between a fixed end 304 and a free end 306. The longitudinal direction is shown generally by arrow A and extends substantially parallel to the respective sides 266, 268. The latch arm 302 is cantilevered such that a portion of the latch 300 is movable and engages the panel 210. Optionally, the latch arm 302 may be movable in a first transverse direction of travel that is perpendicular to the longitudinal direction and perpendicular to the respective side 266, 268 (e.g. generally toward or away from the side 266, 268), which is shown by arrow B. The latch arm 302 may movable in a second transverse direction of travel that is perpendicular to the longitudinal direction and parallel to the respective side 266, 268 (e.g. generally along the side 266, 268), which is shown by arrow C. In an exemplary embodiment, the first and second travel directions of the latch arm 302 are along curvilinear or arcuate paths as the free end 306 is pivoted or rotated about the fixed end 304. In an exemplary embodiment, the latch arm 302 is generally C-shaped having a cupped portion that extends generally rearward, however, other shaped arms may be used in alternative embodiments. Other shapes may include an S-shape, a U-shape, a linear shape, a curvilinear shape, and the like. Optionally, the latch arm 302 may include two fixed ends and a free portion therebetween that is movable or deflectable.

The latch 300 includes a locking finger 310 at or near the free end 306 of the latch arm 302. The locking finger 310 extends outward from the latch arm 302 generally away from the housing 240. The locking finger 310 includes a front surface 312, a rear surface 314, a top 316 and a bottom 318. When assembled with the panel 210, the rear surface 314 engages the panel 210 to resist removal of the housing 240 in a rearward direction. Additionally, the top 316 engages the panel 210 to resist removal of the housing in an upward direction.

FIG. 2 illustrates the latch 300 in a resting position, wherein the latch 300 is generally parallel to the respective side 266 or 268 and spaced apart from the side 266 or 268. The latch 300 is deflectable from the resting position (e.g. in the first transverse direction shown by arrow B), such that when the latch arm 302 is squeezed or forced inward toward the housing 240, the free end 306, and thus the locking finger 310, is moved toward the housing 240 to a deflected position (not shown). Optionally, the free end 306 may abut the side 266 or 268 of the housing 240 when the latch 300 is deflected to the deflected position. When the latch 300 is deflected, the latch arm 302 rotates or pivots about the fixed end 304 perpendicular to the plane of the latch arm 302. The latch 300 may be returned to the resting position from the deflected position when the installer releases the latches 300. From the deflected position, the latch 300 may also be deflected or retracted in a rearward direction parallel to the side 266 or 268 (e.g. in the second transverse direction shown by arrow C) to a retracted position (not shown). The latch 300 may be retracted by pulling, or otherwise forcing, the latch arm 302 in the direction of the rear 242 of the housing 240. For example, the cupped portion of the C-shaped latch arm 302 may define a finger hold or grip for the user to squeeze the latch arm 302 inward or pull the latch arm 302 rearward. The latch arm 302 may have alternative configurations, shapes or elements to accomplish rearward deflection of the latch arm 302, such as a projection or non-planar configuration that allows the user to grip the latch arm 302. When the latch 300 is deflected in such directions, the latch arm 302 rotates or pivots about the fixed end 304. The latch arm 302 is fabricated from a material having elastic characteristics, such as a polymer material, that returns the latch arm 302 to the resting position after being deflected.

Figure 3:
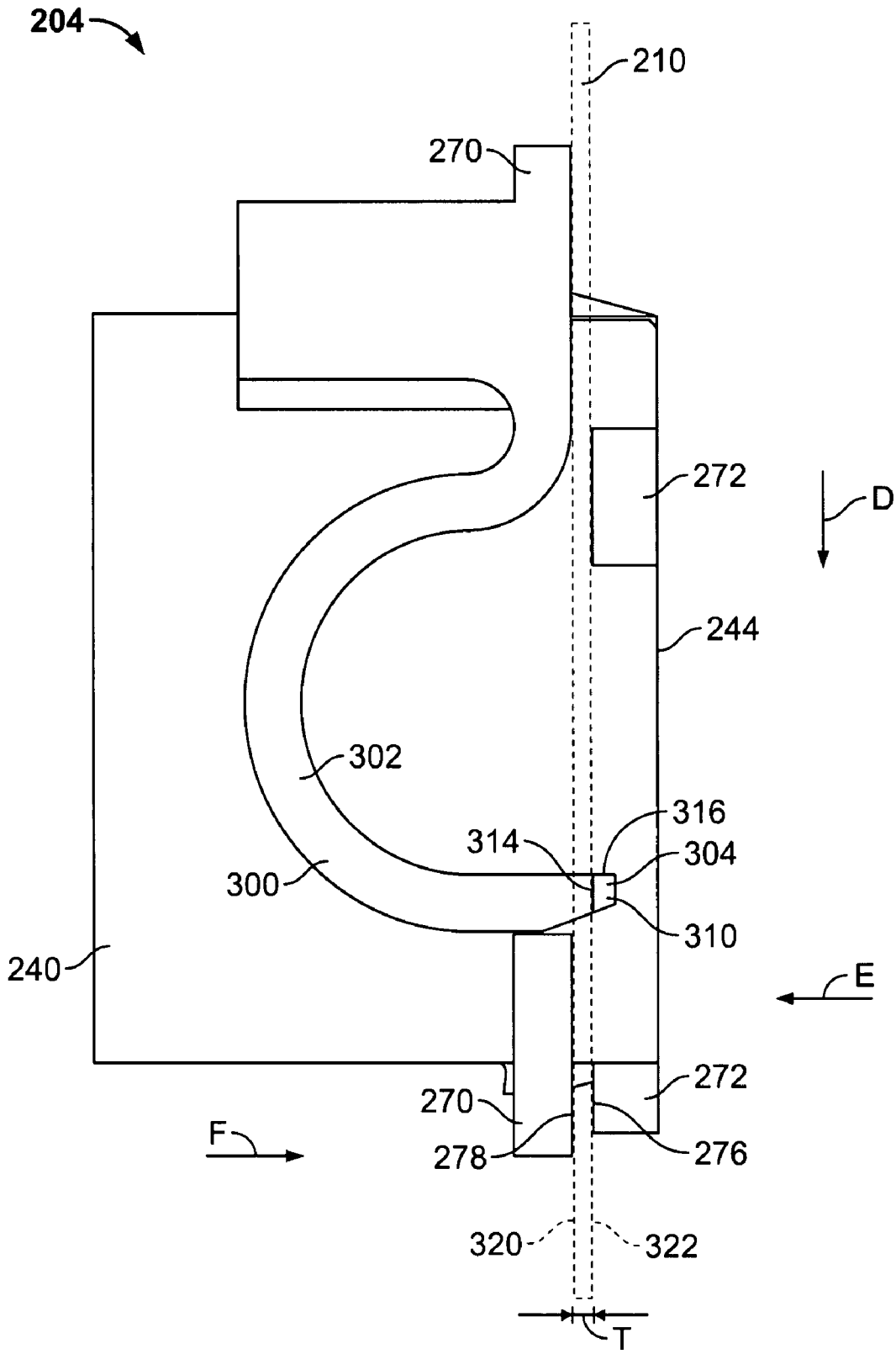
FIG. 3 is a side view of the plug connector shown in FIG. 2.

FIG. 3 is a side view of the plug connector 204 mounted to the panel 210, which is shown in phantom. During assembly, the plug connector 204 is loaded through the opening 248 (shown in FIG. 1) from a rear of the panel 210 and the front 244 of the housing 240 extends through the opening 248. In an exemplary embodiment, the housing 240 is loaded through the opening 248 until the inner mounting tabs 270 abut against the panel 210. The housing 240 is then slid in a mounting direction, shown by arrow D, to a mounted position (e.g. the position illustrated in FIG. 3). When mounted, the inner and outer mounting tabs 270, 272 cooperate to hold the housing 240 in position with respect to the panel 210. The forward facing surfaces 278 of the inner mounting tabs 270 extend along an inner panel surface 320 of the panel 210, while the rearward facing surfaces 276 of the outer mounting tabs 272 extend along an outer panel surface 322 of the panel 210. The inner and outer mounting tabs 270, 272 are spaced apart a predetermined distance that corresponds to the thickness T of the panel 210. As such, the panel 210 may be rigidly held between the mounting tabs 270, 272.

When mounted, the free end 304 of the deflectable latch 300 also extends through the opening 248 of the panel 210. The locking finger 310 is positioned along the outer panel surface 322 such that the rear surface 314 of the locking finger 310 engages the outer panel surface 322. In an exemplary embodiment, the rear surface 314 of the locking finger 310 is co-planar with the rearward facing surfaces 276 of the outer mounting tabs 272. When the rear surface 314 and the rearward facing surfaces 276 engage the panel 210, the locking finger 310 and the mounting tabs 272 resist removal of the housing 240 from the panel 210 in a rearward direction, which is shown by arrow E. Similarly, the forward facing surfaces 278 of the inner mounting tabs 270 resist advancement of the housing 240 in the forward direction, which is shown by arrow F. Additionally, the top 316 of the locking finger 310 engages the panel 210 to resist movement of the housing 240 along the panel 210 in an upward direction, or a direction opposite to the mounting direction, which is shown by arrow D. In an exemplary embodiment, the deflectable latch 300 is positioned proximate to, and may rest on, a top surface 324 of the lower inner mounting tab 270. The inner mounting tab 270 thus represents and operates as stop element to inhibit removal of the housing 240 from the opening 248 when the latch 300 is in the resting or locked position. The inner mounting tab 270 resists inadvertent removal of the latch 300 from the opening 248 when the latch 300 has not been purposefully deflected by the operator for removal of the housing 240. The inner mounting tab 270 engages the latch 300 to limit movement of the housing 240 in the upward direction while the locking finger 310 engages the panel 201. When a user attempts to move the housing 240 in an upward direction opposite to the direction of arrow D without first deflecting the latch 300 toward the housing 240, the latch 300 engages the inner mounting tab 270. More particularly, the top surface 324 engages a corresponding bottom surface of the latch 300 so that the latch 300 cannot be forced out of the opening 248.

Figure 4:
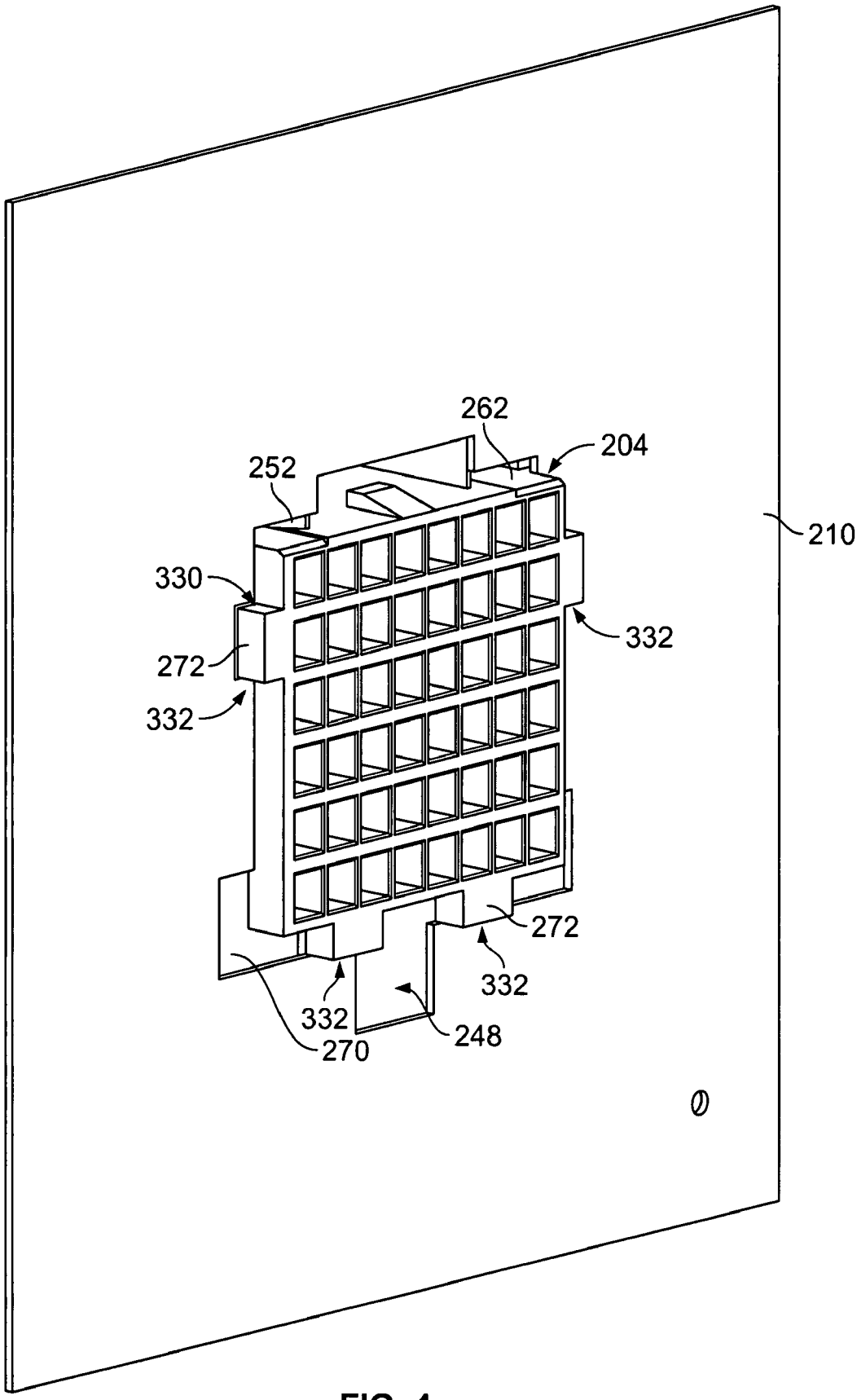
FIG. 4 is a perspective view of the plug connector during a first stage of assembly.
Figure 5:
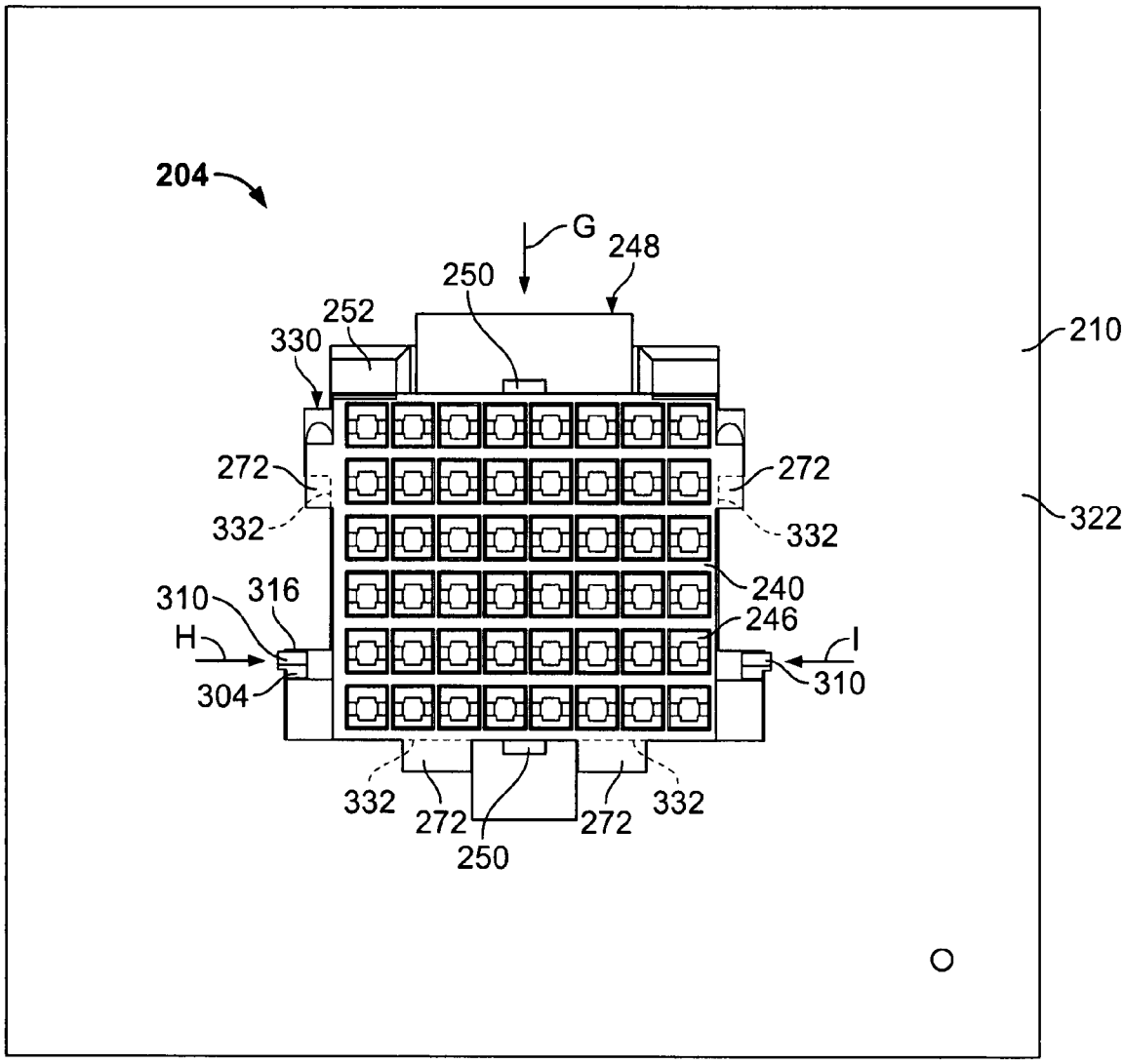
FIG. 5 is a front view of the plug connector during a final stage of assembly.

FIG. 4 is a perspective view of the plug assembly 204 and the panel 210 during an initial stage of assembly. In the initial stage of assembly, the plug housing 240 is loaded through the opening 248 in the panel 210 to a loaded position. During loading, the plug housing 240 is aligned with the opening 248 and the outer mounting tabs 272 proximate the top 262 are aligned with notch-out portions 330 in the panel 210, which are also illustrated in FIG. 5. The notch-out portions 330 may serve as keying features to ensure proper orientation of the housing 240 with respect to the panel 210. In the loaded position, the mounting tabs 270, 272 are aligned with respective mounting portions 332 of the panel 210. The mounting tabs 270, 272 are configured to engage, or mount to, the mounting portions 332 of the panel 210.

In the illustrated embodiment, when the housing 240 is positioned in the loaded position, the inner mounting tabs 270 abut against the panel 210. The deflectable latches 300 (shown in FIG. 3) are positioned behind the panel 210 and are retracted parallel to the side 266 or 268 in the direction of the rear 242 of the housing 240. Optionally, when the housing 240 is positioned in the loaded position, the blind mating members 252 may be at least partially blocked by the panel 210 such that the receptacle connector 202 (shown in FIG. 1) cannot be mated with the plug connector 204. As such, mating will not occur pre-maturely.

FIG. 5 is a front view of the plug assembly 204 and the panel during a final stage of assembly. The plug housing 240 is transferred to the final stage from the initial stage (illustrated in FIG. 4) by forcing the plug housing 240 in the mounting direction, shown generally by arrow G, to a mounted position, such as the position illustrated in FIG. 5. For example, the housing 240 may be slid along the panel 210 in the mounting direction. In the final stage of assembly, the plug housing 240 is securely mounted to the panel 210 by overlapping the mounting portions 332 (shown in phantom in FIG. 5) of the panel 210 with the outer mounting tabs 272.

When the housing 240 is positioned in the mounted position, the blind mating members 252 are exposed by the opening 248 of the panel 210 such that the receptacle connector 202 may be mated with the plug connector 204. Additionally, the locking members 250 and the contact cavities 246 are exposed by the opening 248. Removal of the housing 240 from the panel 210 is accomplished by moving the housing 240 in an upward direction, which is generally opposite to the mounting direction shown by arrow G, from the mounted position to the loaded position. The housing 240 may be removed by then moving the housing 240 rearward, pulling the housing 240 back through the opening 248 until the housing 240 is free from the panel 210.

In the mounted position, the deflectable latches 300 (shown in FIG. 3) may be used to lock the housing 240 into the opening 248 of the panel 210. In use, once the housing 240 is positioned in the mounted position, or alternatively, as the housing 240 is being moved to the mounted position, the latches 300 are deflected in respective deflecting directions, which are shown by arrows H and I, to deflected positions (not shown in FIG. 5). The deflecting directions of the latches 300 are opposite one another. Optionally, the latches 300 may be deflected by the installer squeezing the arms 302 (shown in FIG. 3) generally toward the housing 240. In the deflected position, the free ends 304 and/or the locking fingers 310 fit through the opening 248. For example, in an exemplary embodiment, the free ends 304 and the locking fingers 310 abut against the respective sides 266 or 268, and the distal ends of the locking fingers 310 clear the edge of the opening 248 such that the locking fingers 310 may be brought through the opening 248.

Once the locking fingers 310 are positioned beyond the outer panel surface 322, the arms 302 and the locking fingers 310 may be moved in locking directions, generally opposite to the deflecting directions shown by arrows H and I, to locked positions, which are illustrated in FIG. 5. In the locked positions, the locking fingers 310 engage the panel 210. When the locking fingers 310 are moved to the locked positions, an audible or tactile signal may be sensed by the installer. For example, the locking fingers 310 may be moved to the locked position by a snap action as the latch arms 302 are released and/or as the locking fingers 310 clear the opening 248. In an exemplary embodiment, the rear surfaces 314 (shown in FIG. 2) of the locking fingers 310 engage the panel 210 such that the locking fingers 310 resists removal of the housing 240 in the rearward direction. In an exemplary embodiment, the tops 316 of the locking fingers 310 also engage the panel 210 such that the locking fingers 310 resist movement of the housing 240 in an upward direction, which is generally opposite to the mounting direction shown by arrow G. As such, the housing 240 cannot be removed from the panel 210 until the deflectable latches 300 are deflected to the deflected position. Optionally, the deflectable latches 300 must also be pulled rearward from the deflected position until the free ends 304 clear the panel 210 to remove the housing 240 from the panel 210. In alternative embodiments, different types of tool-less latches or brackets may be used to lock the housing 240 within the opening 210 in a convenient and efficient manner.

While FIGS. 4 and 5 illustrate the plug connector 204 in initial and final stages of assembly, respectively, it is realized that the terms "initial" and "final" are used to describe the assembly stages with respect to one another. It is also realized that other assembly stages or steps may occur before the initial stage illustrated and described with respect to FIG. 4 and that other assembly stages or steps may occur after the final stage illustrated and described with respect to FIG. 5. It is also realized that un-mounting of the plug connector 204 from the panel 210 may occur, and some or all of the steps described above may be performed in the opposite order to un-mount the plug connector 204.

Figure 6:
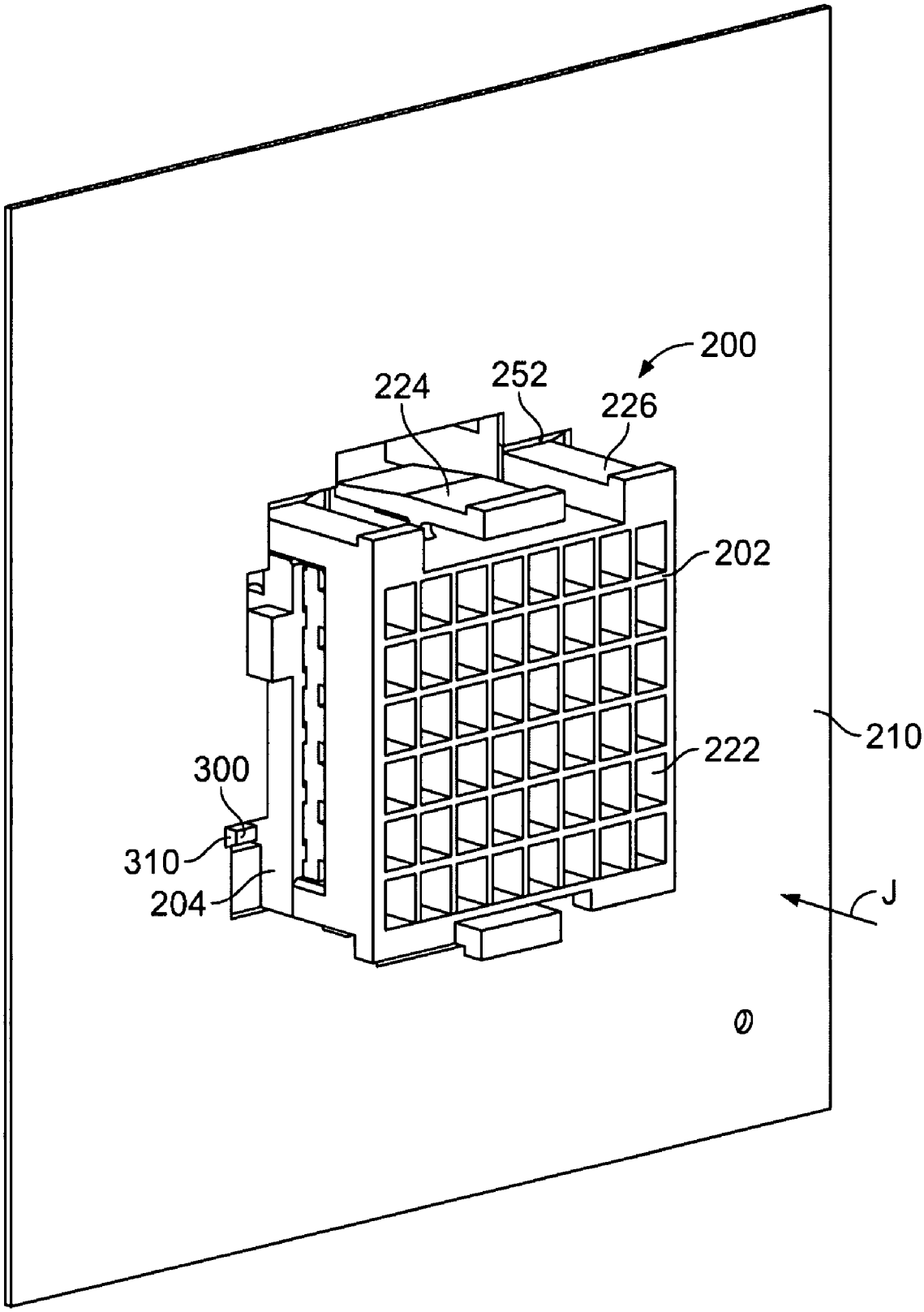
FIG. 6 is an assembled view of the connector assembly illustrated in FIG. 1.

FIG. 6 is a perspective view of the connector assembly 200 in an assembled state. Once the plug connector 202 is in the mounted position and the latches 300 are in the locked position, the receptacle connector 202 may be mated with the plug connector 204. The contact cavities 222 of the receptacle connector 202 are aligned with the contact cavities 246 (shown in FIG. 1) of the plug connector 204 and the connectors 202, 204 are mated. The receptacle connector 202 is transferred in a mating direction, shown generally be arrow J, to the mated position. During mating, the blind mating members 226 of the receptacle connector 202 are loaded into the openings representing the blind mating members 252 of the plug connector 204. Additionally, the latches representing the locking members 224 of the receptacle connector 202 are attached to the locking members 250 (shown in FIG. 1) of the plug connector 204. Once assembled, a reliable cable-to-cable interconnection is made between the connectors 202, 204.

A connector assembly 200 is thus provided in a cost effective and reliable manner. The connector assembly 200 includes a slide-to-lock plug connector 204 mounted to the panel 210 in a convenient and efficient manner. Notably, the plug connector 204 may be mounted to the panel 210 without the use of a tool, and a blind connection may occur. The plug connector 204 includes mounting tabs 270 and 272 that engage the panel 210 and latches 300 that lock the plug connector 204 in position with respect to the panel 210. The latches 300 are deflectable along two different axes, one parallel to the sides of the housing 240 of the plug connector 204, the other perpendicular to the sides of the housing 240. The latches 300 are deflected by a thumb and finger of the installer between deflected or retracted positions and a resting position. The plug connector 204 may also be locked in place to avoid unintentional or inadvertent removal of the plug connector 204 from the panel 210. For example, a locking finger 310 engages the panel in the resting position. Additionally, the snap-action of the locking fingers 310 to the panel 210 may provide an audible or tactile signal to the installer that the plug assembly 204 is properly mounted to the panel 210. Mating of the plug connector 204 with a receptacle connector 202 is made convenient by the blind mating members 226 and 252 and by the optional staggering of the contacts into at least two groups. Mating of the plug connector 204 with the receptacle connector 202 is made secure by the locking members 224 and 250. The interconnection of the connectors 202, 204 may also be accomplished without the use of additional fasteners or tools, and without thumbscrews.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. An electrical connector for mounting to a panel, the connector comprising:

a housing configured to be mounted to the panel, the housing having mounting tabs that are configured to engage the panel; and a deflectable latch including a latch arm having a length extending in a longitudinal direction between a fixed end secured to the housing and a free end movable with respect to the housing, the free end having a locking finger extending therefrom, the latch arm extending along a resting plane defined by the latch arm when the latch arm is in a resting position, wherein the latch arm is forced from the resting plane and deflected laterally with respect to the resting plane to align the locking finger with an opening through the panel, the deflectable latch returning towards the resting position when the latch arm is no longer forced from the resting plane so that the locking finger engages the panel, wherein at least one of the mounting tabs is positioned to engage a surface of the latch to inhibit removal of the housing from the panel opening when the latch is in the resting position.

2. The connector of claim 1, wherein the deflectable latch is deflectable in a deflecting direction generally toward the housing and a locking direction generally away from the housing.

3. The connector of claim 1, wherein the housing includes side walls extending between a front and a rear of the housing, the latch arm being secured to the housing and extending parallel to one of the side walls when in the resting position.

4. The connector of claim 1, wherein the latch arm is secured to a side wall of the housing and the latch arm extends parallel to the side wall, the latch arm being deflectable in a first deflecting direction transverse to the longitudinal direction and perpendicular to the side wall, and the latch arm being deflectable in a second deflecting direction transverse to the longitudinal direction and parallel to the side wall.

5. The connector of claim 1, wherein the panel includes a single opening, the housing and the locking finger both extend through the single opening.

6. The connector of claim 1, wherein the deflectable latch includes a C-shaped body extending between the fixed end and the free end.

7. An electrical connector for mounting to a panel, the connector comprising:

a housing having a front, a rear and side walls extending between the front and the rear, the housing being configured to be loaded through an opening in the panel to a loaded position, and wherein the housing is configured to be slid in a mounting direction to a mounted position;

mounting tabs extending from the housing, wherein the mounting tabs define outer mounting tabs positioned proximate to the front of the housing and inner mounting tabs extending from the housing and being recessed from the front of the housing and spaced apart from the outer mounting tabs by a distance, the distance being substantially equal to a thickness of the panel, the outer mounting tabs being configured to be loaded through the opening with the housing, each outer mounting tab having a rear surface facing the rear of the housing, the rear surface configured to engage the panel when the housing is slid in the mounting direction to the mounted position, the inner and outer mounting tabs cooperating to hold the panel therebetween; and a latch secured to the housing, the latch having a locking finger, the latch being deflectable to permit the locking finger to move through the opening when the housing is in the mounted position, and the locking finger engaging the panel when the housing is in the mounted position.

8. The connector of claim 7, wherein the mounting tabs are configured to be loaded through the opening with the housing as the housing is moved to the loaded position.

9. The connector of claim 7, wherein each rear surface of the mounting tabs are co-planar and configured to engage a forward facing surface of the panel as the housing is slid to the mounted position.

10. The connector of claim 7, wherein the locking finger has an engagement surface, and wherein each rear surface of the mounting tabs is co-planar with the engagement surface to engage a forward facing surface of the panel as the housing is slid to the mounted position.

11. The connector of claim 7, wherein the latch is deflectable in a deflecting direction generally toward the housing and a locking direction generally away from the housing.

12. The connector of claim 7, wherein the latch is secured to one of the side walls and the latch extends parallel to the side wall, the latch is deflectable in a first deflecting direction transverse to the longitudinal direction and perpendicular to the side wall, and the latch arm being deflectable in a second deflecting direction transverse to the longitudinal direction and parallel to the side wall.

13. The connector of claim 7, wherein the latch includes a fixed end secured to the housing and a free end movable with respect to the housing, the free end having the locking finger extending therefrom for engaging the panel.

14. The connector of claim 7, wherein at least one of the mounting tabs is positioned to engage a surface of the latch to inhibit removal of the housing from the panel opening when the housing is in the mounted position.

15. An electrical connector for mounting to a panel, the connector comprising:

a housing having a front, a rear and side walls extending between the front and the rear, the housing being configured to be loaded through an opening in the panel to a loaded position, and wherein the housing is configured to be slid in a mounting direction to a mounted position; and a deflectable latch secured to the housing, the deflectable latch includes a latch arm extending in a longitudinal direction between a fixed end and a free end, the latch arm having a locking finger at the free end of the latch arm, the locking finger being positioned to engage the panel when the latch arm is in a resting position to lock the housing in position with respect to the panel, wherein the latch arm is deflectable in a first deflecting direction transverse to the longitudinal direction and generally perpendicular to an adjacent one of the side walls to move the locking finger relative to the opening, and the latch arm is deflectable in a second deflecting direction transverse to the longitudinal direction and generally parallel to the adjacent one of the side walls to move the locking finger relative to the opening.

16. The connector of claim 15, wherein the panel includes a single opening, the housing and the locking finger both extend through the single opening.

17. The connector of claim 15, wherein the housing includes mounting tabs that are configured to engage the panel, at least one of the mounting tabs positioned to engage a surface of the latch to inhibit removal of the housing from the panel opening when the latch is in the resting position.

18. The connector of claim 15, wherein the housing is configured to be moved between the mounted position and the loaded position when the latch arm is in the retracted position.

19. The connector of claim 15, wherein the latch arm is moved generally towards or away from the adjacent side wall as the latch arm is deflected in the first deflecting direction, and wherein the latch arm is moved generally towards either the front or the rear as the latch arm is deflected in the second deflecting direction.

* * * * *